United States Patent [19]

Putt et al.

[11] 4,084,867

[45] Apr. 18, 1978

[54] STORAGE CABINET FOR SKI EQUIPMENT

[76] Inventors: Bernard J. Putt, Star Rte. Box 169, Howard, Colo. 81233; Roger E. Hughet, 5635 Putnam, West Bloomfield, Mich. 48033

[21] Appl. No.: 648,905

[22] Filed: Jan. 14, 1976

[51] Int. Cl.[2] ..... A47B 53/00; A47F 7/00

[52] U.S. Cl. ..... 312/198; 312/229; 312/324; 211/60 SK; 211/34

[58] Field of Search ..... 312/198, 199, 321, 324, 312/229, 340, 3, 4, 305, 291, 292; 211/34, 35, 60 SK

[56] References Cited

U.S. PATENT DOCUMENTS

| | | | |
|---|---|---|---|
| 1,975,779 | 10/1934 | Church | 312/324 |
| 2,286,539 | 6/1942 | Hagerstrom | 211/35 |
| 2,317,516 | 4/1943 | Brace | 211/35 |
| 2,326,064 | 8/1943 | Pittman | 211/34 X |
| 2,415,518 | 2/1947 | Niesner | 211/35 |
| 2,488,431 | 11/1949 | Parnell et al. | 312/305 |
| 2,584,219 | 2/1952 | Murrell | 312/229 |
| 2,790,555 | 4/1957 | Horchner | 211/34 |
| 2,956,812 | 10/1960 | Lundquist | 211/60 SK |
| 3,826,378 | 7/1974 | Novak | 211/60 SK |
| 3,913,745 | 10/1975 | Weiss | 211/34 |

FOREIGN PATENT DOCUMENTS

| | | | |
|---|---|---|---|
| 171,886 | 1960 | Sweden | 312/198 |
| 1,084,913 | 9/1967 | United Kingdom | 211/34 |

*Primary Examiner*—Paul R. Gilliam
*Assistant Examiner*—Victor N. Sakran
*Attorney, Agent, or Firm*—Harry R. Dumont

[57] ABSTRACT

A cabinet having an interior compartment for storing snow skis and poles vertically in an orderly arrangement within the compartment. At least one interior sidewall of the compartment is formed by a molded fiberglass half-section having specially formed and positioned receptacles for storing ski boots. A drip pan is mounted in a removable manner at the bottom of the compartment. The skis are mounted on a ski rack which is movable in a telescoping manner to the exterior of the cabinet to make loading and unloading of the skis easier and further to improve the access to the boots in their stored position. The rack has mounted on it specialized ski supports for holding the skis in matched pairs in a vertical position and hanger rods are provided to mount the skis poles, likewise in a vertical position. A second vertical compartment is also preferably included in side-by-side relationship to the ski equipment compartment with shelves, drawers and hangers for storing additional ski accessories such as jackets, pants, parkas, mittens, goggles and the like.

1 Claim, 20 Drawing Figures

FIG. 12
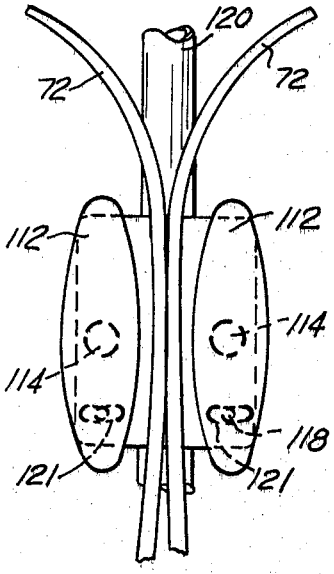
FIG. 13
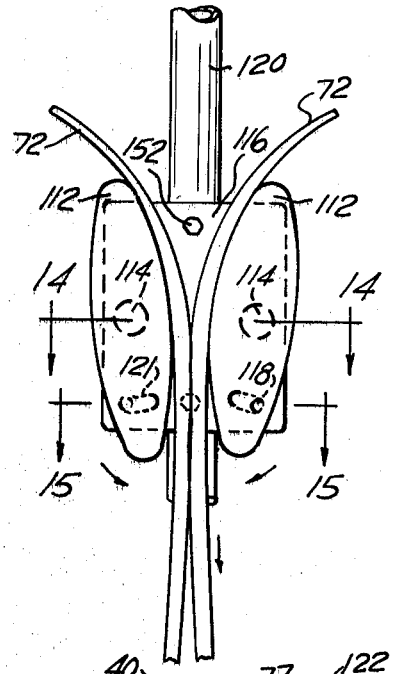
FIG. 14
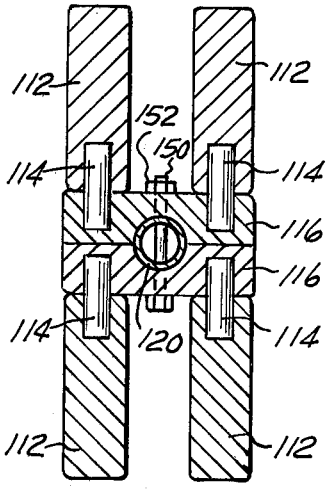
FIG. 16
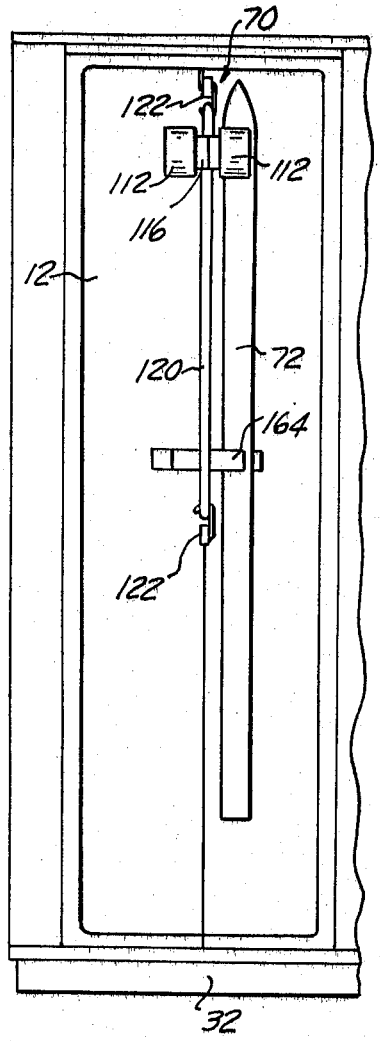
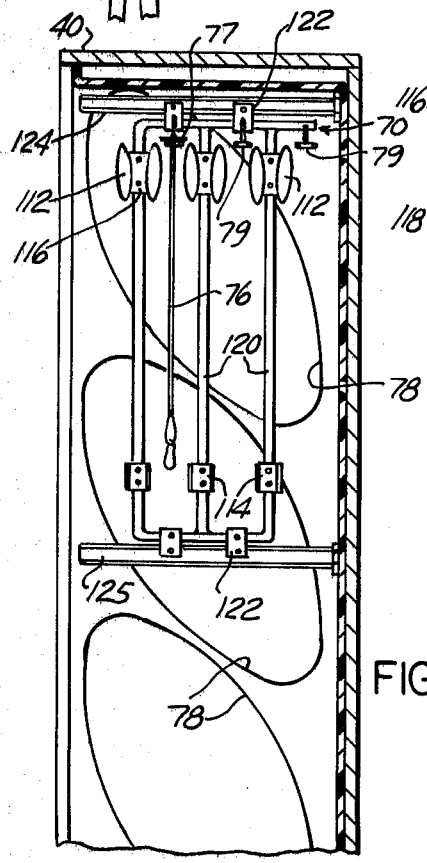
FIG. 17
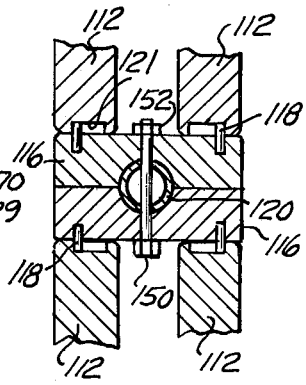
FIG. 15

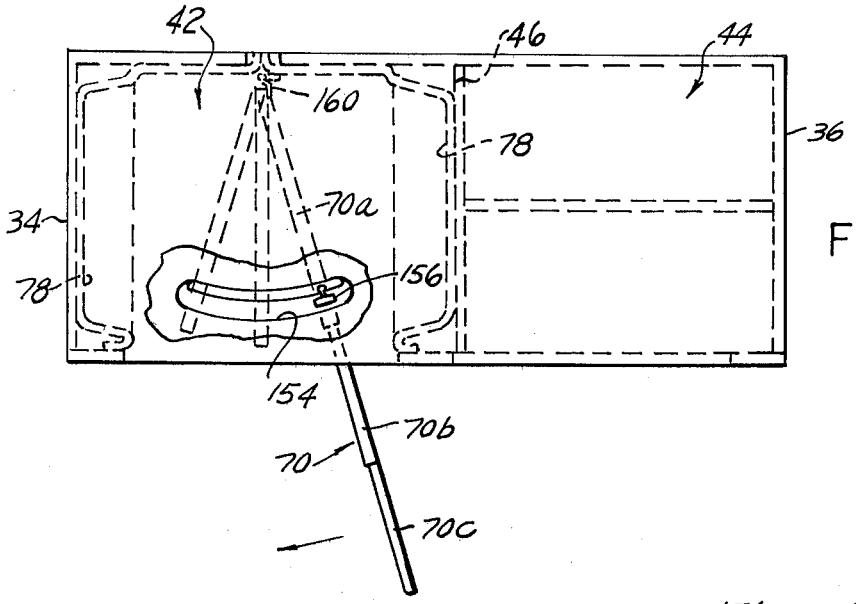
FIG. 18
FIG. 19
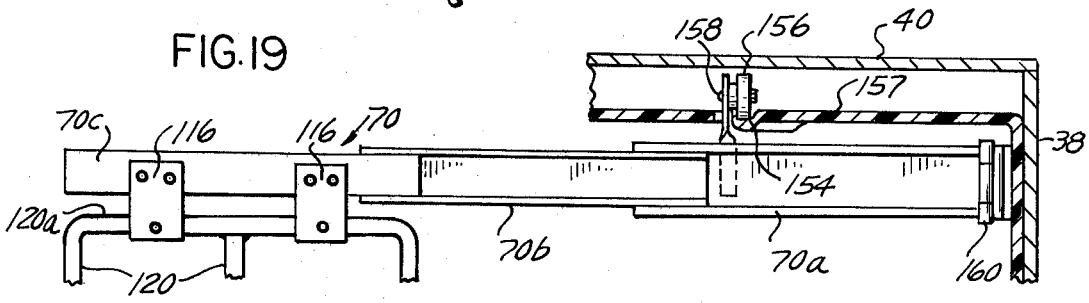
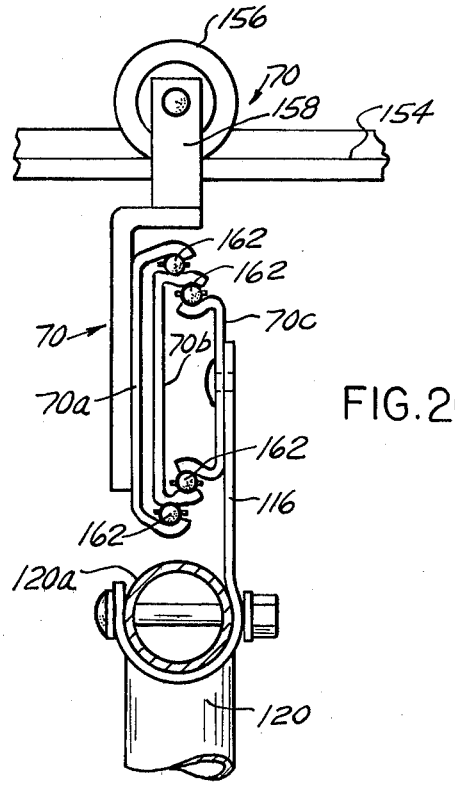
FIG. 20

STORAGE CABINET FOR SKI EQUIPMENT

BACKGROUND OF THE INVENTION

Skis, related equipment and accessories present problems in their storage between use. When they are brought inside a dwelling, they are frequently covered with ice and snow so that they should not be left leaning in the usual manner against walls with their ends resting on floors because of the water drainage which results. In families where there are a number of skiers, the resultant clutter and mix-up of equipment can cause a problem.

The present invention provides an optimum arrangement in a free-standing cabinet for ski equipment which allows movement of the cabinet within the dwelling to a suitable location during skiing season and then to a different storage location when the equipment is not in use.

It is further essential that a cabinet provided for such equipment be designed and constructed not only to maintain a neat appearance and a safe and orderly arrangement of the ski equipment but also to provide for safe drainage of the water from the equipment as it dries and for removal of the moisture laden air from the compartment.

BRIEF DESCRIPTION OF THE PRESENT INVENTION

The present invention will be seen to provide a relatively simple constructed, inexpensive and free-standing cabinet in which skis, ski boots and poles and all related clothing and equipment can be stored even though they are in a wet or icy condition. It enables the storage of the various items of equipment in related groups and pairs, conveniently put away and ready for use. The cabinet constructed in accordance with this invention allows for secure storage of the equipment in a vertical orientation in such manner that they are securely held against accidental dislodgment until removal is made.

A novel holding arrangement is provided for gripping and clamping the skis in pairs proximate their tips. This clamping is provided by ellipsoidal or oval holding elements which urge the skis together along their entire length. A further boot holding arrangement includes preformed receptacles for boot pairs which are so aligned and formed as to provide for drainage from the boots in a pattern away from the other boots.

BRIEF DESCRIPTION OF THE DRAWINGS

The attached drawings illustrate a system provided in accordance with the present invention in which like numerals and letters are used to identify like parts of the system where they may occur in the several different drawings, and in which:

FIGS. 12 and 13 are side elevational views which illustrate a still different embodiment of a pivotal type of ski holder used in conjunction with the present invention. FIG. 12 shows the skis as they are being inserted into the holder and FIG. 13 shows the skis and ski holder in the final ski gripping position;

FIG. 14 is a sectional view taken along the section line 14—14 of FIG. 13;

FIG. 15 is a further sectional view taken along the section line 15—15 of FIG. 13;

FIG. 16 is a front elevational view of the ski holding structure and rack showing one pair of skis in their retained position;

FIG. 17 is a right elevational view showing the rack and ski holders together with one ski pole and its supporting hanger;

FIG. 18 is a top plan view of the cabinet with parts broken away to show the pivotal mounting for the ski holder rack and further showing the rack in its extending position;

FIG. 19 is a right side elevational view with parts broken away further illustrating the extended position of one rack used to support the skis and ski holders; and FIG. 20 is a partial end view showing the telescoped ski supporting rack and a part of the rotative mounting for allowing its pivotal movement.

DETAILED DESCRIPTION OF THE PREFERRED EMBODIMENT

Figure 1:
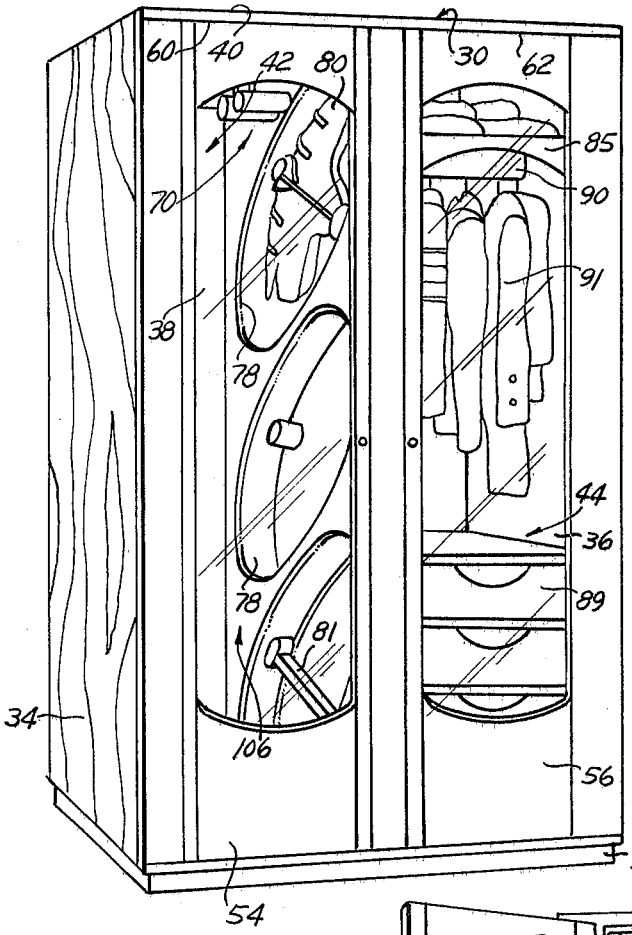
FIG. 1 is a front perspective view of the cabinet in accordance with the present invention.

Particular attention is drawn to the cabinet 30 as best shown in FIG. 1 with the front doors in a closed position. The cabinet 30 has a base 32, side walls 34 and 36, a rear wall 38 and a top 40. The interior of the cabinet is generally divided into two compartments 42, 44 by an interior vertical wall 46. The compartments 42, 44, respectively, have front openings 60, 62. A pair of doors 54, 56 are hinged in the openings respectively to the sidewalls 34, 36 for closing the openings.

The left hand compartment 42 is particularly constructed and arranged for storing skis, ski poles and ski boots, while the right hand compartment 44 is constructed and arranged primarily for storing skiing accessories and items of clothing such as jackets, ski pants, hats, gloves and the like.

Figure 3:
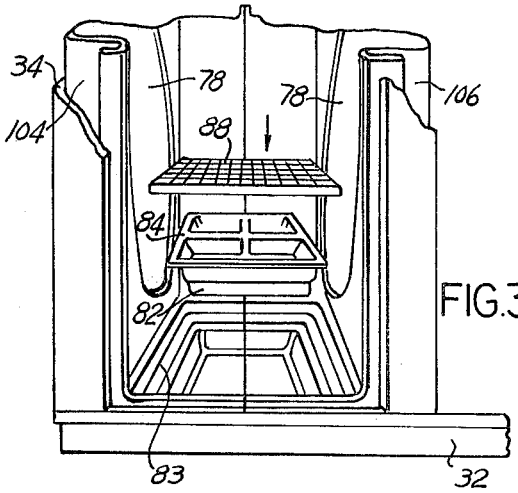
FIG. 3 is an exploded view showing the drain and associated parts at the base of the cabinet.

A rack 70 is suspended within the chamber 42 for supporting the skis 72 which preferably are arranged back-to-back in matched pairs. Each individual ski pole 76 is hung by its basket in a laterally extending bifurcated bracket 79 as better shown in FIG. 17. The compartment 42 is lined with a pair of opposed half-section molded panels 104, 106, each of which has a vertical array of three appropriately shaped receptacles 78, each providing a recess in which a pair of ski boots 80 on a carrier 81 may be stored. For the left hand compartment 42 in the base 32 there is provided a drip pan 82 having an upper edge 84 adapted to be fitted within a recess 83 in the base 32. The assembly for drainage from the stored skis and ski boots further includes an upper grate 88 and the assembly is illustrated in its separated position in FIG. 3.

Figure 4:
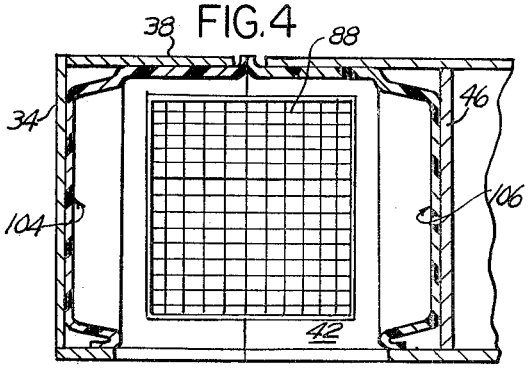
FIG. 4 is a top plan view likewise showing the drain construction and sidewalls and boot holder detail.

FIG. 4 likewise shows the arrangement of the grate 88 as it is fitted in the bottom of the compartment 42. It further illustrates the construction of the left hand molded panel 104 and the right hand molded panel 106 and the manner in which receptacles 78 are formed in these panels.

Figure 2:
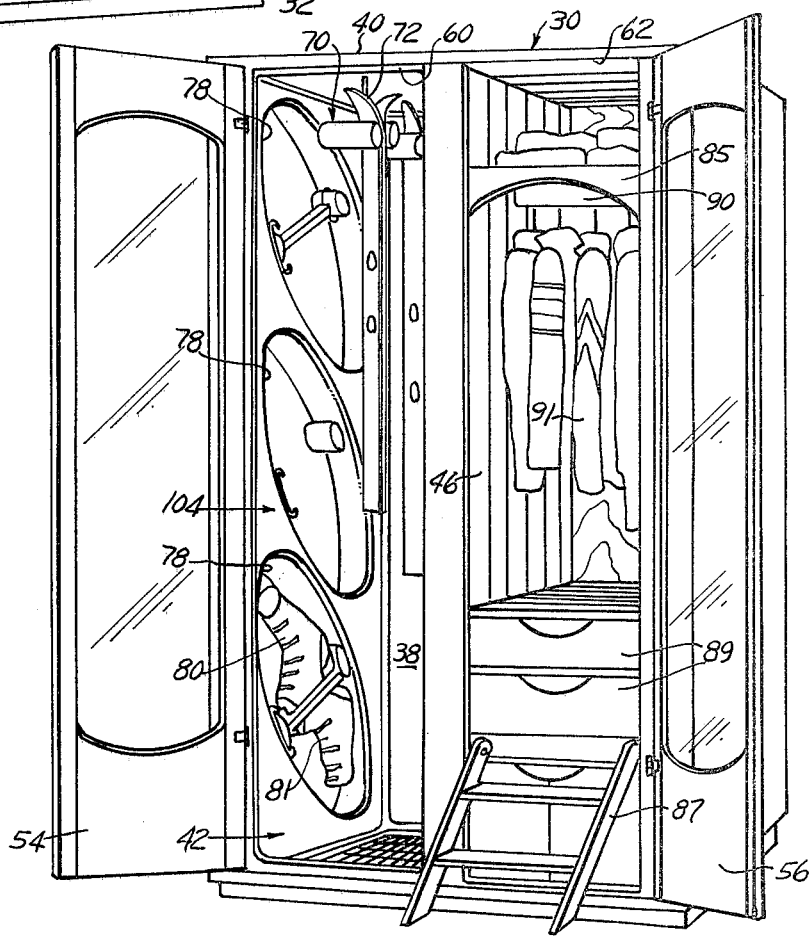
FIG. 2 is a different front perspective view of the cabinet according to the present invention with the cabinet doors open.

The right hand compartment 44, as best shown in FIG. 2, includes a garment mounting bar 90 for hanging the jackets 91 and further includes a plurality of lower drawers 89 and an upper shelf 85. To provide access to the upper shelf 85, a folding ladder 87 is pivotably mounted near its top end near the base of the right hand compartment 44. The ladder 87 is shown in its extended position in FIG. 2. It will be understood that the drawers 89 are adatped to hold various accessories such as socks, gloves and the like. The upper shelf 85 is further adapted to hold sweaters and other items of ski clothing.

Figure 5:
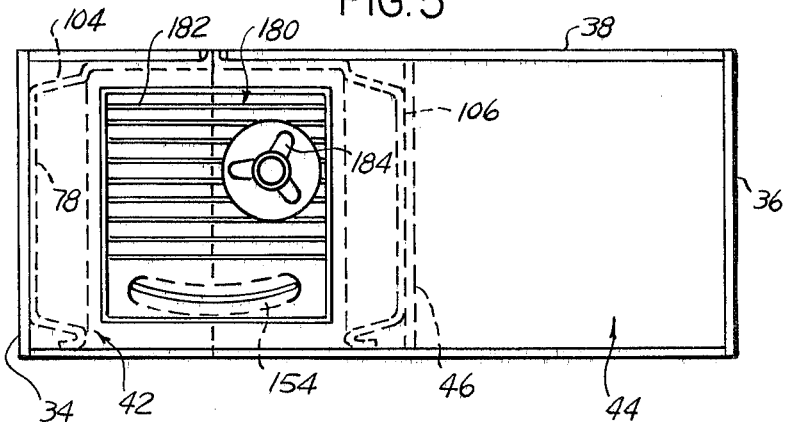
FIG. 5 is a partial view of the cabinet with top cover removed.

FIG. 5 shows the ventilating system 180 used to remove moieture laden air from the compartment 42. The system 180 includes an upper adjustable louver opening 182. A ventilator fan 184 is used to exhaust the air from the top of the compartment 42. The fan 184 is connected to the driveshaft of a suitable electrical drive motor, not shown.

Figure 8:
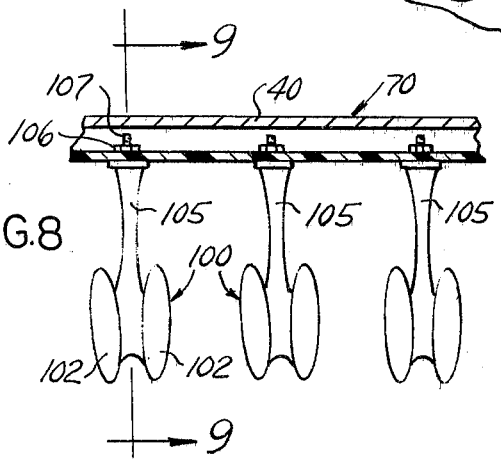
FIG. 8 is a partial sectional and side elevational view showing one embodiment of ski holders and associated rack.
Figure 9:
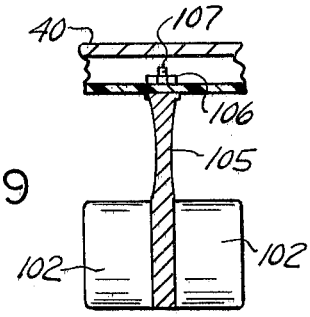
FIG. 9 is a fragmentary sectional view taken along the section line 9—9 of FIG. 8.

Reference is now made to FIGS. 8 and 9 and their showing of one type of system for holding the skis in a vertical stored position. FIG. 8 shows in part the rack 70 to which is attached a plurality of holding devices 100. The holding devices 100 include a pair of fixed oval or ellipsoidal-shaped knobs 102 having their longitudinal axes substantially aligned in a vertical direction. The shaping of the knobs 102 and the spacing therebetween is for the purpose of holding a pair of skis in back-to-back relationship and further clamping them together over a substantial portion of their length. This is accomplished by inserting the skis with their curved tip ends in the general manner later illustrated in FIGS. 12 and 13 and then gently letting them slide into engagement with the opposed curved surfaces of the knobs 102 so that there will be a clamping effect and the skis will be held substantially firmly in back-to-back relationship. The skis can easily be removed by just slightly lifting the pair of skis to release the clamping forces. FIGS. 8 and 9 show an arrangement for mounting six different pairs of skis and to this end each set of knobs 102 are mounted in back-to-back relationship with a separate set of knobs 102, all extending laterally in opposite directions and depending from a common vertical shank 105. The shank 105 has a threaded holding attachment 107 at its upper end and it is further held to the rack 70 by a threaded fastener 106. The FIG. 9 drawing illustrates the manner in which opposed pairs of knobs 102 extend in an opposite lateral direction from each shank 105.

Figure 10:
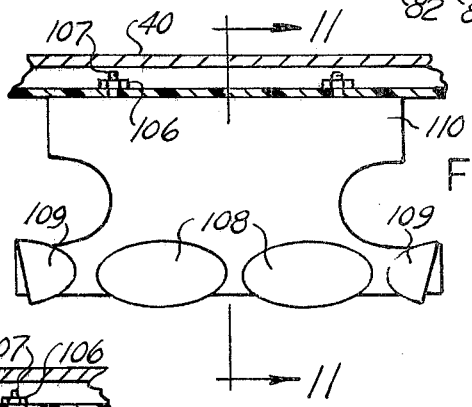
FIG. 10 is a side elevational view showing a different embodiment of a structure used for holding the skis.
Figure 11:
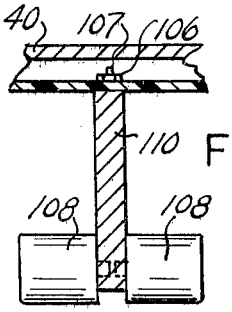
FIG. 11 is a sectional view taken along the section line 11—11 of FIG. 10.

FIGS. 10 and 11 show a somewhat different embodiment of the present invention with respect to the manner in which the oval or ellipsoidal holding parts are formed and oriented. FIG. 10 shows a pair of end opposed oval or ellipsoidal knobs 108 and a further end pair of half-ellipsoidal knobs 109 cooperable therewith. The arrangement of FIG. 10 likewise has the capability of accommodating and hanging in a vertical direction six different pairs of skis. To this end, a plate 110 has mounted on it sets of opposed pairs of knobs 108 as better shown in FIG. 11. It should be noted that the ellipsoidal knobs 102 of FIG. 8 or knobs 108 of FIG. 10 are in each case fixed either to their respective shank or back mounting plate. It is the particular curved shaping of the knobs themselves which greatly improves the clamping effect against each set of two back-to-back skis 72 to hold them in longitudinally aligned position.

FIGS. 12–15 show a still further embodiment of sets of ellipsoidal holding elements 112 which are used to grip the pair of skis 72 at a point proximate their upper curved tips. In this case the knobs 112 are pivotally mounted proximate their midpoints on pins 114. They are thus enabled to rotate in the manner better shown in FIG. 13, each in respective clockwise and counterclockwise directions to abut against the opposed surfaces of the skis 72 after they have been dropped between the two knobs 112. The pins 114 are each fixed to a vertically upstanding plate 116. A pair of studs 118 extend outwardly from the plate 116 and each engages a curved slot 121 formed in the inner surface of the opposed knob 112. As the skis 72 are dropped between each pair of knobs 112, these pivot until the outer end of the slots 121 are in abutment with each stud 118.

FIGS. 16 and 17 further illustrate in greater detail the construction of the rack 70 and its associated parts. The rack 70 includes a plurality of vertical tubes 120 arrayed in side-by-side relationship and attached at their ends to slider blocks 122, which slidably engage tracks 124, 125 at their upper and lower ends. This permits an inward and outward movement of the entire rack 70, better to provide access to the skis held in the rack. Also included in the rack 70 are the brackets 79 used for holding the ski poles 76 in place vertically by engaging these below their baskets 77. As also shown in FIG. 15, the arrangement for mounting each pair of plates 116 about the associated tube 120 includes a bolt 150 and a fastener nut 152.

Further embodiments of the rack 70 will be shown and described in connection with FIGS. 18–20. The general parts included in FIG. 18 relate to a somewhat different embodiment of the ski rack 70 in that a plurality of sections **70*a*, 70*b* and 70*c* are mounted in telescoping relationship one with the other to allow pull-out of the mounted skis from the compartment 42 for load and unload. There is also provided a mechanism for pivotal movement of the rack 70 within an arcuate track 154 formed in an inner plate 157 suspended and spaced from the upper top 40 of the cabinet 30. The track 154 is adapted to carry a roller 156 in its arcuate movement. The innermost rack section 70*a* has fixed to it an upstanding bracket 158 which rotatively carries the roller 156. Thus, the three telescoping sections 70*a*, 70*b* and 70*c* are allowed a pivotal movement, rightwardly or leftwardly, to provide access to either the right hand or the left hand boot receptacles 78. FIG. 18 shows in dash line configuration several of the different positions which are possible with the swiveling movement of the rack 70. FIG. 19 illustrates the placement of plates 116 and the tubes 120 which carry the lower disposed knobs 112 (not shown). A hinge mounting 160 is preferably provided at the right hand end of the rack section 70*a* as shown in FIG. 19. FIG. 20 further seves to illustrate the general arrangement of the parts of the telescoping ski rack 70 as they are viewed from an endwise position and in a telescoped setup. The several different track sections depending from the bracket 158 are slidably and freely rollable one on the other through a plurality of ball bearings 162** mounted therebetween in a manner well known in the art.

Figure 6:
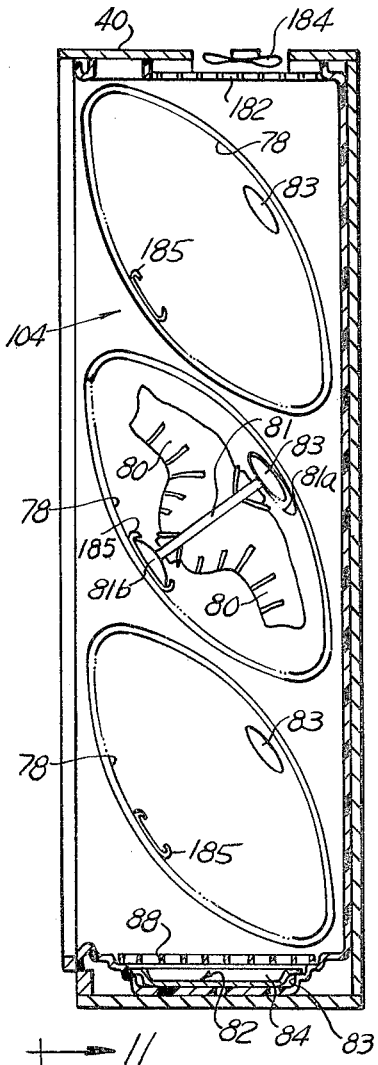
FIG. 6 is a front view of one of the side panels with receptacles for holding ski boots and carrier.
Figure 7:
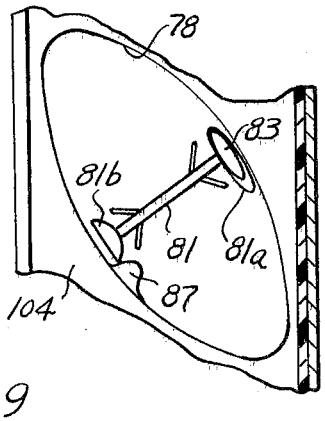
FIG. 7 is a partial view similar to FIG. 6 showing a different holding system for ski boots and carrier.

The system for mounting the boots 80 and their respective carriers 81 is of particular importance in the general combination of mounting structures used in the left hand compartment 42. A similar problem exists with respect to storing ski boots so that they may drain and dry in their mounted or stored position, particularly as shown in FIGS. 6 and 7. The arrangement or receptacles 78 one relative to the other and their configuration allows drainage of melting snow and ice from each different pair of boots 80 in a generally vertical direction to the drip pan 82. Because of the generally oval shape of the several boot receptacles 78 and the slanted orientation of their major axes, the flow of water, with reference to FIG. 6, is from lower right hand corner of upper receptacle 78 to the lower right hand corner of the others and finally to drip pan 82 at the base. This greatly accelerates the drying of each of the boot pairs. Each boot carrier 81 includes a stand end 81*b* and a handle end 81*a*. The receptacle 78 includes a securing means for each carrier 81 which comprises an extension 83 for engaging the handle end 81*a* and a clip 185 for yieldably engaging the stand end 81*b*.

In the alternate embodiment of FIG. 7, the clip 185 is replaced by an abutment formed to retain the end 81*b* in place, while the opposite end 81*a* is held in place by the extension 83. It will be understood that the panel 104 and its associated boot receptacles 78, while illustrated in the compartment arrangement, may also be used as a separate wall hanging arrangement for boots. Although the panels 104 and 106 could be molded from any suitable plastic-like material, fiberglass reinforced expoxy or urethane is preferred due to the size and configuration of the panels.

It has been found that adequate storage facilitates for six skiers can be provided by a cabinet having an inner height only slightly greater than the height of most downhill skis presently in use. Since conventional ceilings are 8 feet, it is desirable that the overall height of the cabinet 30 be somewhat less than 8 feet and slightly greater than 7½ feet.

It will thus be seen that by our invention a novel arrangement for skis and ski equipment has been provided.

We claim:

1. A storage cabinet for storing a plurality of wet ski boots which comprises:

a walled compartment;

a drain mounted proximate the base of said compartment;

a molded panel mounted on at least one of the walls of said compartment, said panel having a plurality of oval-shaped receptacles formed therein of substantially the same size; said receptacles having their longitudinal axes substantially parallel and trans-horizontal, said receptacles further vertically spaced one from the other and vertically aligned, each of said receptacles further having means for securing a ski boot pair in mounted relationship therein; a boot carrier for holding each of said boot pairs in sole to sole relationship in its respective receptacle, each boot carrier including a stand element at one end and a handle element at the other end, said securing means in said receptacles comprising a pair of opposed securing resilient clips one engageable with a stand element and the other engagable with a handle element of the associated boot carrier, the lowermost of said receptacle adapted to receive water drainage seriatim from those above it and to pass such water to said drain.

* * * * *